United States Patent [19]

Berger

[11] 4,412,637

[45] Nov. 1, 1983

[54] BIDIRECTIONAL DOCUMENT FEED TRACTOR UNIT

[75] Inventor: Michael A. Berger, Richardson, Tex.

[73] Assignee: Datamarc, Inc., Dallas, Tex.

[21] Appl. No.: 309,462

[22] Filed: Oct. 5, 1981

[51] Int. Cl.[3] ..... B65H 29/12; B65H 17/38

[52] U.S. Cl. ..... 226/172; 226/74; 226/76

[58] Field of Search ..... 226/172, 74, 76, 75, 226/9, 171, 170

[56] References Cited

U.S. PATENT DOCUMENTS

| | | | |
|---|---|---|---|
| 2,840,217 | 6/1958 | Nelson et al. | 226/74 X |
| 3,209,972 | 10/1965 | Benbow | 226/74 X |
| 3,608,801 | 9/1971 | Nystrand | 226/74 X |
| 3,669,327 | 6/1972 | Dowd | 226/172 X |
| 4,129,239 | 12/1978 | Hubbard | 226/75 |
| 4,214,691 | 7/1980 | Namen | 226/74 X |

*Primary Examiner*—John M. Jillions
*Assistant Examiner*—Dao Van Huynh
*Attorney, Agent, or Firm*—Hubbard, Thurman

[57] ABSTRACT

A bidirectional document tractor unit having spaced apart laterally adjustable tractor mechanisms each provided with an endless tractor belt which is in driving engagement with a document support belt to provide a document path interposed between the support belt and the tractor belt. The support belts include perforations engageable with the drive pins on the tractor belt. The support belts also are drivably engaged with sprocket members having document drive pins formed thereon. The tractor belts are driven through suitable sprockets in driving engagement with an elongated driveshaft. Movable gates are disposed adjacent to the drive sprockets which provide for lead-in driving engagement with the document which is trained along the tractor belt between the tractor belt and the support belt, then through the printer platen and then along the opposite run of the tractor belts before returning to a document magazine or stack. Formed rod support bars are provided for maintaining oppositely moving runs of the document spaced apart from each other.

20 Claims, 8 Drawing Figures

BIDIRECTIONAL DOCUMENT FEED TRACTOR UNIT

BACKGROUND OF THE INVENTION

1. Field of the Invention

The present invention pertains to a feed mechanism for driving document forms of indeterminate length through a printer platen and comprising spaced apart tractor mechanisms having cooperating sets of endless belts which provide improved bidirectional feeding and ease of loading the document into the tractor mechanisms.

2. Background Art

In the art of feeding documents into and out of various printer units, it is known to provide so-called tractor mechanisms which include endless drive belts having a series of lugs or pins which are adapted to engage spaced apart perforations along the opposed longitudinal sides of the document to provide positive feeding of the document with respect to the printer platen. There are also known document feed tractors which provide for bidirectional driving of the document while maintaining correct spacing of the printed lines and feeding of the document in and out of the platen. However, known types of bidirectional tractor mechanisms are difficult to load when the document is initially fed through the tractor mechanism to commence the feeding process.

For example, one known type of bidirectional tractor mechanism includes spaced apart frames on which endless drive belts are mounted and which include gates or guide members disposed adjacent the opposed longitudinal runs of the belts. The gates are pivotally mounted on the tractor mechanisms and are adapted to be opened for loading the document during the initial feeding of the document into the printer. However, the opposed openable gates are difficult to manipulate for proper loading of the document to assure that the document is engaged by the correct teeth or pins on the belts.

Accordingly, it has become highly desirable to provide improved document feed tractors which are easy to load without risk of damaging the document or inadvertently arranging the document with incorrect spacing with respect to the tractor drive belts. In the latter case, and with respect to the ease of loading of the documents, it is important that the document not be damaged by the tractor mechanism since, in many instances, the documents are serially numbered or have printed material already disposed thereon before being loaded into a particular printer. The present invention is directed to much needed improvements in document tractors which may be easily loaded and which provide bidirectional drive or feed capability.

SUMMARY OF THE INVENTION

The present invention provides an improved document tractor unit having a pair of tractor mechanisms which are arranged to provide for driving or feeding a continuous form having spaced apart perforations along opposite longitudinal sides thereof, said tractor mechanisms being capable of driving the forms in both directions with respect to a printer and said tractor mechanisms being easily loaded with the documents to follow a path in engagement with and along one side of the tractor mechanisms, through the printer platen and then in engagement with and along the opposite side of the tractor mechanisms.

In particular, the present invention provides for a document tractor mechanism including a tractor head having an endless belt with spaced apart lugs or pins projecting therefrom and being trained around spaced apart sprockets mounted on a tractor frame, and wherein a second endless belt is mounted adjacent to and movable in timed relation with the tractor drive belt to provide for holding the document in engagement with the opposite run of the tractor drive belt to thereby provide improved bidirectional drive capability of the tractor unit.

In accordance with one aspect of the present invention, the second or idler belt is drivably engaged with a document feed sprocket having a plurality of drive lugs and pins spaced around the circumference thereof and the same distance apart as the drive lugs of the tractor belt. The idler belt and the feed sprocket are driven by the tractor drive belt through the drive pins on the tractor drive belt which are engaged with spaced apart apertures in the idler belt.

In accordance with another aspect of the present invention, a bidirectional document tractor unit is provided having document guide members or gates which are easily opened to permit loading of the document initially into the tractor drive mechanism, and which gates are pivotally mounted above the feed sprocket which is drivably engaged with an idler belt and wherein the idler belt is drivably engaged by the tractor belt.

The present invention is further characterized by an improved document tractor mechanism wherein a conventional unidirectional document tractor may be adapted to provide bidirectional drive capability by the addition of mechanism including an idler belt mounted to traverse in timed relationship and in direct engagement with the tractor drive belt. The idler belt is drivably engaged with a feed sprocket mounted to engage the document strip at the lead-in or exit point on the document travel path with respect to the tractor mechanism.

In accordance with yet another aspect of the present invention, there is provided an improved document tractor unit adapted to be removably mounted on printer units having a rotatable printer platen for driving the document and supporting the document adjacent the printer head, said tractor unit having improved document guides for separating the opposed runs of the document approaching and leaving the tractor mechanisms. The improved guides are of formed wire and are adapted to maintain the opposite runs of the document strip spaced apart from each other to eliminate frictional drag forces thereon.

In accordance with yet a further aspect of the present invention, there is provided a document tractor unit of lightweight, compact and mechanically simple construction utilizing a frame comprising a pair of spaced apart support plates which are connected, respectively, to opposite ends of an elongated beam and supporting therebetween a driveshaft for the spaced apart document tractor mechanisms as well as a support shaft disposed parallel to and spaced from the driveshaft. The support shaft and the frame beam cooperate to support a pair of slidable or adjustable document guide and support members which may be adjustably spaced along the support shaft. The respective document tractors including the bidirectional idler mechanism are also adjustably positionable along the support shaft to accommodate various document widths.

Those skilled in the art of document tractor units will recognize further superior features and advantages of the present invention upon reading the detailed description which follows in conjunction with the drawings.

DESCRIPTION OF THE PREFERRED EMBODIMENT

Figure 1:
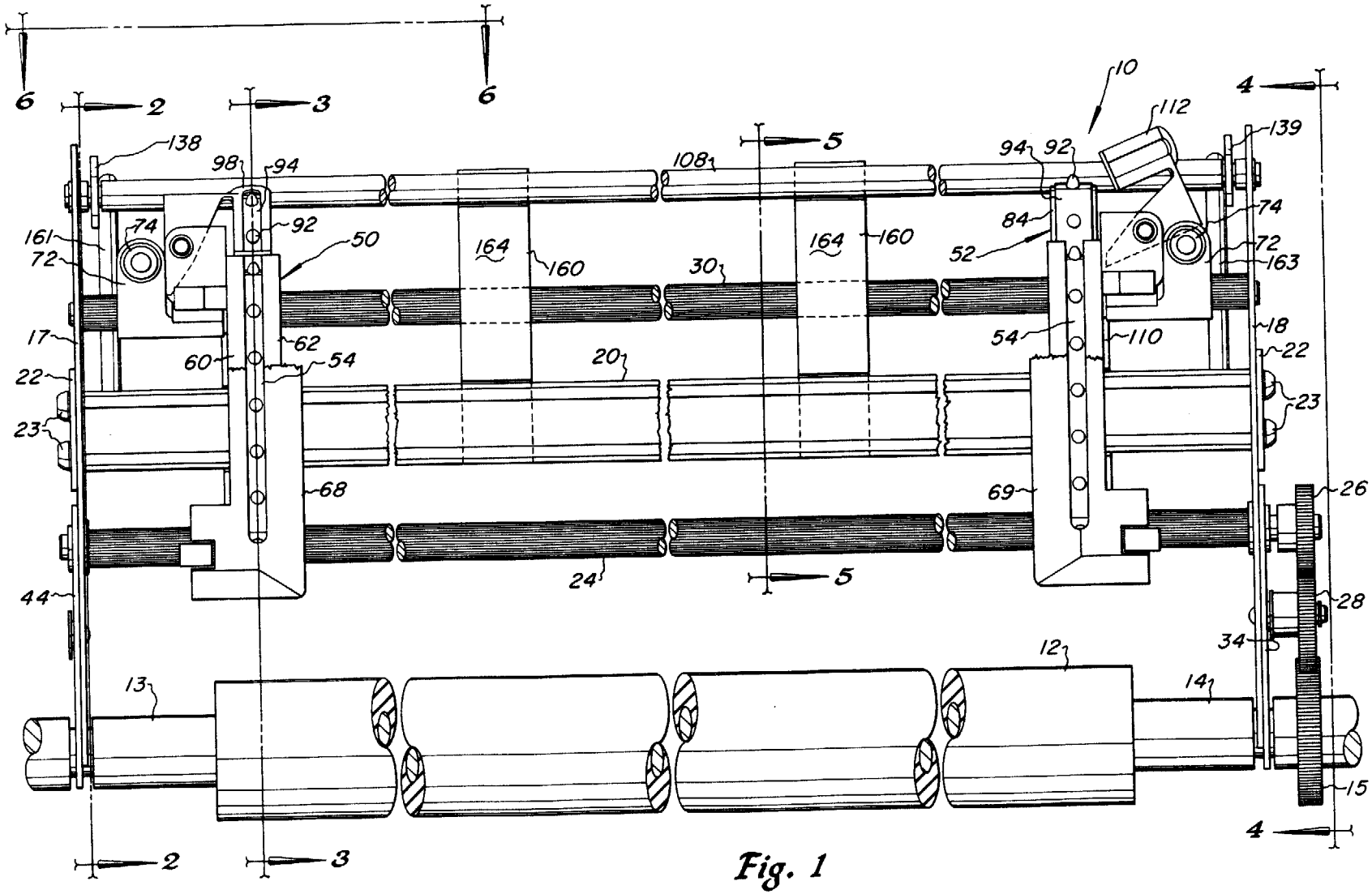
FIG. 1 is a longitudinal front elevation of the document tractor unit of the present invention.
Figure 2:
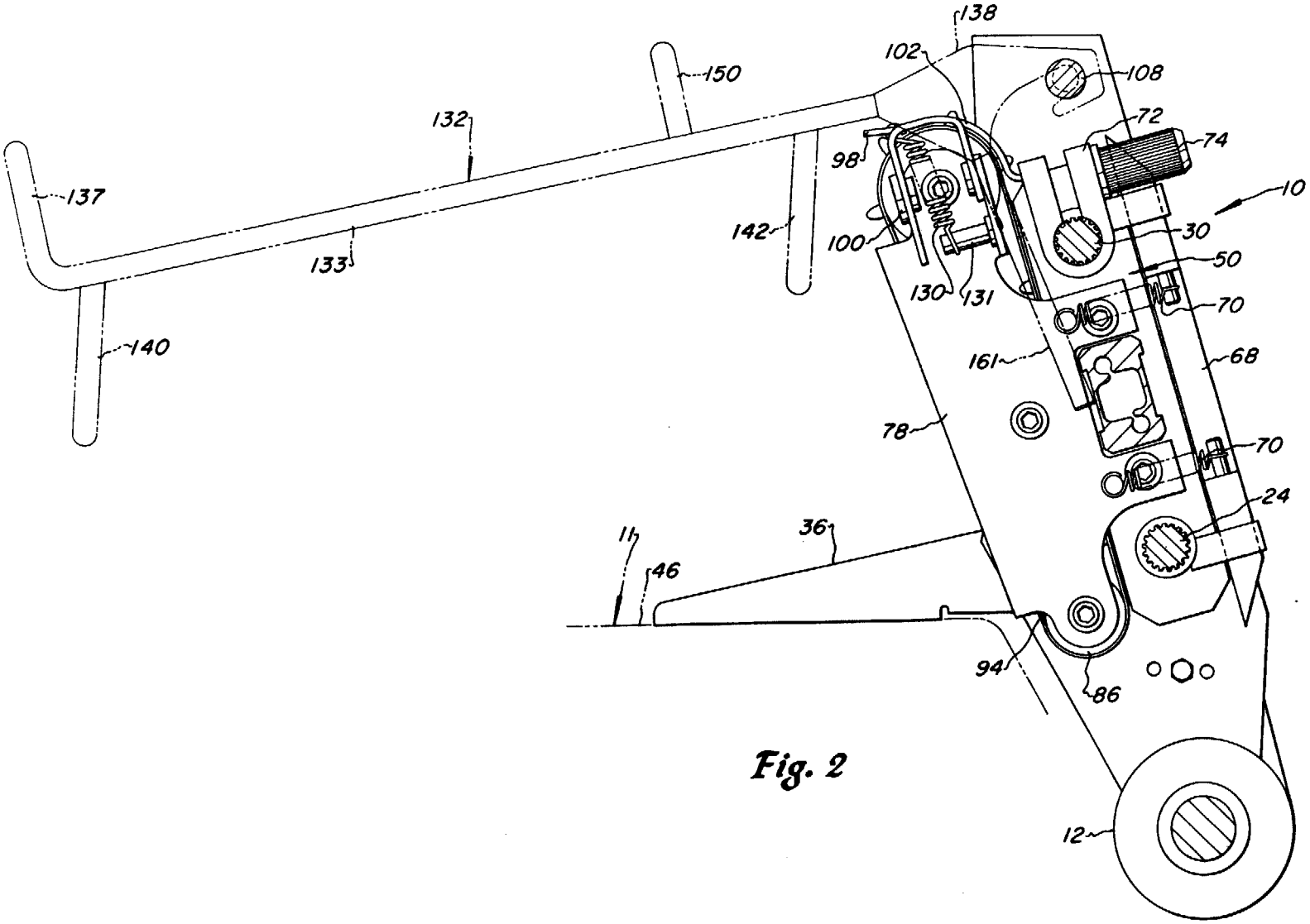
FIG. 2 is a left side elevation of the document tractor unit taken along the line 2—2 of FIG. 1.
Figure 3:
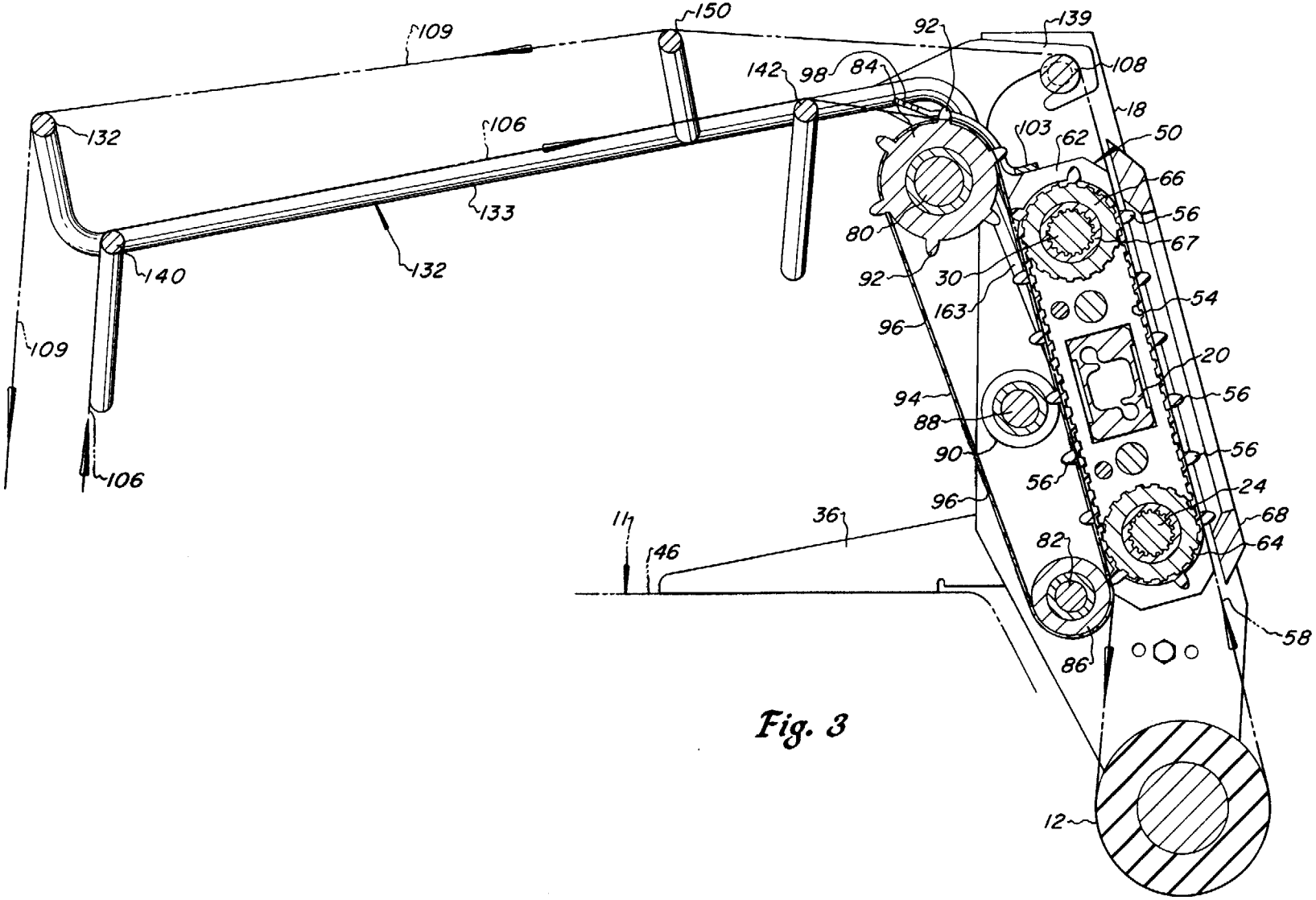
FIG. 3 is a section view taken along the line 3—3 of FIG. 1.
Figure 4:
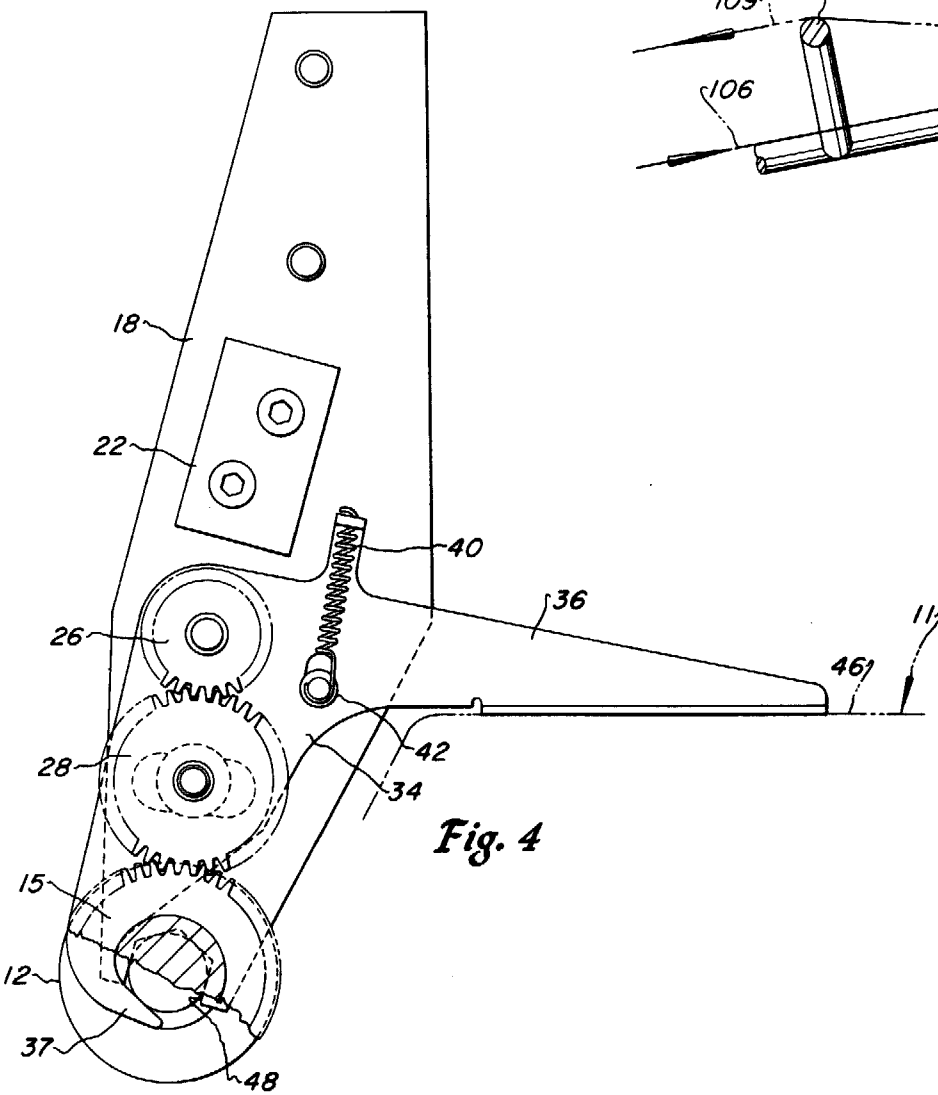
FIG. 4 is a side elevation view taken from the line 4—4 of FIG. 1.

Referring to FIGS. 1 and 2 of the drawings, in particular, the present invention comprises an improved document tractor unit, generally designated by the numeral 10 which is adapted to mount on an automatic printer 11, partially illustrated in schematic form, in a generally known manner. The tractor unit 10 is adapted to mount on one of several types of automatic printers of the type which include a generally cylindrical platen 12 rotatably mounted on the printer and adapted to support a document while character impressions are made thereon. The platen 12 includes oppositely projecting support shaft portions 13 and 14, one or both of which may have mounted thereon a drive gear 15, as shown in FIGS. 1 and 4. The tractor unit 10 is characterized generally by a pair of spaced apart frame plates 17 and 18 which are interconnected by an elongated beam 20 having a generally rectangular cross-sectional shape. The beam 20 may, as illustrated in FIG. 3, comprise a lightweight metal extrusion of structural aluminum, for example, which is suitably disposed in cooperating rectangular openings formed in the plates 17 and 18 so that the plates have no tendency to rotate or twist with respect to the beam. The plates 17 and 18 are provided with separate support plate portions 22 which are suitably fixed to respective ones of the support plates and covering the openings for the beam 20. The plates 17 and 18 are secured to the support beam 20 by suitable threaded fasteners 23. The particular arrangement illustrated for the frame of the tractor unit 10 comprising the plates 17 and 18 and the beam 20, provides a substantial rigid structure wherein the plates themselves do not have any tendency or twist or become lose with respect to the beam.

The tractor unit 10 is further characterized by an elongated driveshaft 24 formed to have a series of circumferentially spaced splines or serrations on the peripheral surface thereof for a purpose to be described in further detail herein. The driveshaft 24 is journalled for rotation by suitable bearing means disposed on each of the support plates 17 and 18 in a somewhat conventional manner. The driveshaft 24 is also adapted, as illustrated in FIGS. 1 and 4, to support a drive gear 26 which is engaged with an idler gear 28 mounted on the support plate 18. The idler gear 28 is, in turn, meshed with the platen drive gear 15, as also illustrated in FIGS. 1 and 2. Accordingly, the driveshaft 24 is rotatably driven in the same direction as the platen 12 at a predetermined speed ratio in relation thereto which will provide correct feeding of the documents by the spaced apart tractor units to be described in further detail herein. The tractor unit 10 also includes a support shaft 30 spaced from and parallel to the driveshaft 24 and extending between the support plates 17 and 18. The support shaft 30 may, in fact, be of the same configuration as the driveshaft 24 for the sake of economy in construction of the tractor unit. The support shaft 30 is not, however, required to be rotatable with respect to the support plate 17 and 18 and accordingly, any suitable method of mounting the support shaft may be provided.

As shown by way of example in FIG. 4, each of the support plates 17 and 18 is adapted to have mounted thereon a clamp member which, for the right hand side of the tractor unit, comprises a member generally designated by the numeral 34. The clamp member 34 is pivotally mounted on the support plate 18 about the axis of shaft 24 and has a support leg 36 extending therefrom in one direction and a clamp hook 37 disposed on an end of the clamp member opposite the support leg 36. A tension coil spring 40 is interconnected between an intermediate portion of the leg 36 and a portion of a pin 42 for supporting the clamp member in such a manner as to bias the clamp member into the retracted or open position. However, when the tractor unit is mounted on the platen 12 of the printer, generally designated by the numeral 11, the leg 36 of the clamp member together with a similar leg portion of a clamp member 44 disposed on the support plate 17 rests against the top surface 46 of the housing of the printer 11. The weight of the tractor unit 10 supported by the leg portions of the clamp members 34 and 44 rotate the clamp members into the clamping position around the respective shaft portions 13 and 14 of the platen 12 to retain the tractor unit engaged with the platen. The support plates 17 and 18 are provided with respective recesses 48, as shown by way of example in FIG. 4, in which the shaft portions 13 and 14 are disposed.

Referring further to FIGS. 1, 2 and 3, the tractor unit 10 includes a pair of spaced apart document tractor mechanisms generally designated by the numerals 50 and 52, respectively. The tractor mechanisms 50 and 52 are characterized by endless belts 54, as shown by way of example, for the tractor mechanism 50 illustrated in FIG. 3, which belts include a plurality of projections or pins 56 which are spaced apart from the each other the same distance as cooperating apertures formed along opposed longitudinal sides of a document strip of indeterminate length, not shown, but following a path generally designated by the numeral 58 in FIGS. 3 and 5. The tractor mechanism 50, for example, includes a frame comprising cooperable sideplates 60 and 62 which are adapted to rotatably support a drive sprocket 64 which is drivably engaged by the driveshaft 24. The tractor mechanism 50 also includes a tractor belt idler sprocket 66 which is rotatably mounted on a bushing 67 disposed on the support shaft 30 and between the plates 60 and 62. The frame formed by the plates 60 and 62 is also provided with a suitable opening to accommodate the support beam 20. The tractor mechanism 52 is substantially the same as the tractor mechanism 50 but is of the opposite hand to provide for engaging the opposite longitudinal side of the document in a known manner.

Each of the tractor mechanisms 50 and 52 is provided with a gate, as shown by way of example, for the tractor mechanism 50 and generally designated by the numeral 68. The gate 68 is hingedly mounted on the frame plate 60 and is adapted to guide the document in the closed position of the gate to prevent a document from disengaging with respect to the tractor belt 54. The gate 68, as well as the corresponding gate 69 on the tractor mechanism 52, opens toward the front of the printer where the printer operator would normally stand to load a document into the printer through the tractor unit 10. The gates 68 and 69 are biased in the closed position by spaced apart coil springs 70 which are interconnected between the gates and the tractor frame plate 60. The springs 70 are connected to the gates in such a way that a stable open and closed position of the gates may be obtained when they are pivoted beyond an over center position, as shown by way of example for the gate 68 in FIG. 6.

The tractor units 50 and 52 are both adjustably mounted on the support shaft 30 and the driveshaft 24 and are fixed in selected positions by clamping mechanisms comprising a split ring portion of one of the frame plates and designated by the numeral 72. The split ring portion 72 is arranged to grippingly engage the support shaft 30 when tightened by a manually adjusted screw 74. Further details of the tractor mechanism 50 and 52, as well as one type of clamping mechanism which may be used in combination with the present invention, is disclosed in greater detail in U.S. Pat. No. 4,129,239 to L. J. Hubbard. The provision of the clamping mechanism, as represented by the split ring portion 72 and the screw 74, provides for adjusting the lateral position of the tractor mechanisms 50 and 52 to accommodate different widths of documents.

Figure 7:
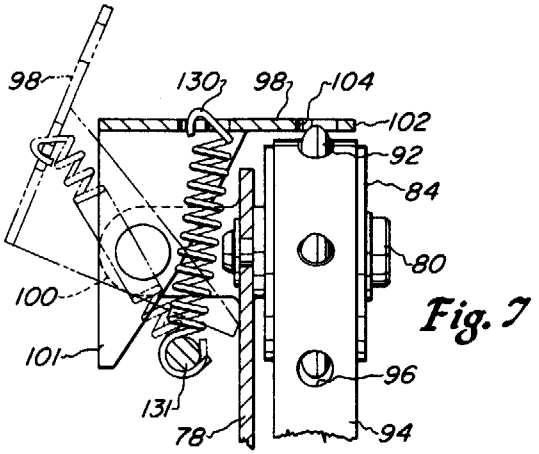
FIG. 7 is a detail view taken along the line 7—7 of FIG. 6 illustrating the open and closed position of one of the gates which are mounted closely adjacent to the respective document drive sprockets.
Figure 6:
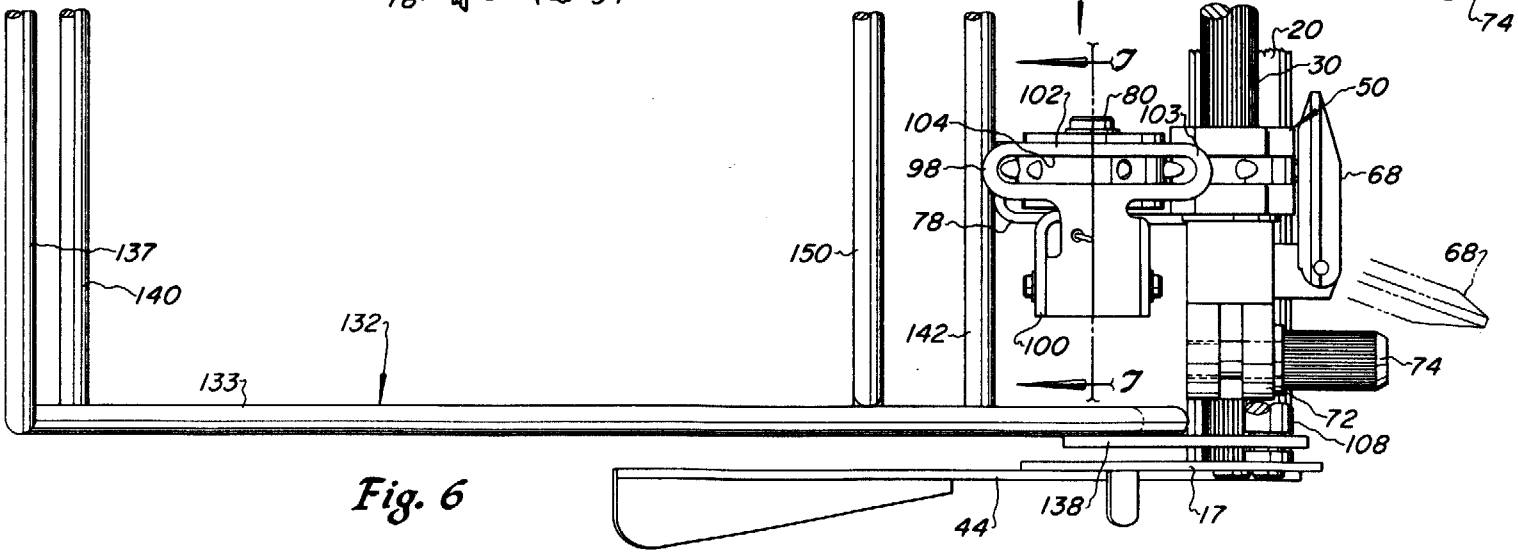
FIG. 6 is a partial plane view taken from the line 6—6 of FIG. 1.

Referring to FIGS. 2, 6 and 7 and by way of example, the tractor mechanism 50 includes a frame plate 78 removably mounted on the frame plate 60 and extending rearwardly therefrom with respect to the front of the tractor unit 10. The frame plate 78 is adapted to support a pair of spaced apart stub shafts 80 and 82 which in turn rotatably support, respectively, a sprocket 84 and a pulley 86. The frame plate 78 also includes a third stub shaft 88, FIG. 2, interposed between the shafts 80 and 82 and rotatably supporting an idler roller 90. The sprocket 84 is provided with circumferentially spaced apart and radially projecting pin portions 92 which are similar in their configuration to the pins 56 on the tractor belt 54. A flexible endless belt 94 is trained over the sprocket 84 and the pulley 86 and is engageable by the idler pulley 90, as indicated in the drawing figures. The belt 94 is provided with a series of longitudinally spaced apart apertures 96 having a spacing equal to the spacing of the pins 56 on the tractor belt 54.

The belts 94 provide support for a document traveling along the path 58 for holding the document in engagement with the tractor belts along the leading run of the tractor mechanisms 50 and 52 in the normal direction of movement of the document through the printer as indicated by the arrows of the path 58. The belts 94 may be made of a plastic or elastomeric material which resists stretching so that the spacing between the holes 96 does not change any more than a change in the spacing between the pins 56. One particular type of material which has been found suitable for the belt 94 is a polyamide material made under the trademark Kapton. As indicated in FIG. 3, the idler pulley 90 has a suitable circumferential groove formed therein to provide clearance for the pins 56 on the tractor belt.

Referring to FIGS. 2, 6 and 7, in particular, the tractor mechanism 50 further includes a movable guide member or gate 98 comprising a formed metal plate member which is pivotally mounted on a clevis portion 100 of the frame plate 78. The gate 98 includes a curved portion 102 having a longitudinal slot 104 formed therein to provide clearance for the pins 92 formed on the periphery of the sprocket 84. The gate 98 also includes a depending leg part 101 which is engageable with the support plate 78 to limit the open position of the gate, and a projection 103, FIG. 3, engageable with the tractor mechanism frame to hold the gate in its closed position. In the closed position of the gate 98, as indicated by the solid lines in FIG. 7, the gate is disposed in close proximity to the support belt 94 to aid in maintaining the document in engagement with the pins 92 formed on the sprocket.

Accordingly, as a document travels over the run portion 106 indicated in FIG. 3, leading toward the tractor mechanism, said document is trained over the sprocket 84, then donwardly between the belts 56 and 94, then downwardly and around the periphery of the platen 12, and then upwardly along the opposite run of the tractor belt 54 in engagement therewith, as provided for in part by the gate 68. The document is then trained around an elongated rotatable roller 108 mounted between the frame plates 17 and 18, as indicated in FIGS. 1 and 2. The document then travels rearwardly along a run 109 with respect to the tractor mechanism 10 in substantially the opposite direction of the run 106.

As will be appreciated from the foregoing description, the tractor mechanism 52 is also provided with a removable frame plate 110 similar to the frame plate 78, but of the opposite hand in the sense that the clevis portion similar to the clevis portion 100 faces in the opposite direction. The tractor mechanism 52 also includes a pivotal gate 112 similar to the gate 98 which is adapted to retain a document in engagement with a sprocket 84 mounted on the frame plate 110 in a manner similar to the mounting of the sprocket 84 on the frame plate 78. The structure described above for the tractor mechanism 50 is also present in the tractor mechanism 52, that is idler pulleys 82 and 90 are provided over which a belt 94 is trained and in engagement with a tractor belt 54 whereby a positive driving engagement of the belt 94 is maintained, as well as a positive drive of the drive sprocket 84 is maintained in timed relation with the tractor belt 54.

Since the gears 15, 26 and 28 are provided to drive the tractor belts 54 in timed relation to the platen 12 at a predetermined linear speed equal to the linear surface speed of the platen, when a document is positively engaged with the pins 92 and 56, the document may be driven in opposite directions of travel in a positive manner wherein there is no loss of position of the document once a line has been printed. Accordingly, additional lines may be printed in predetermined positions on the document both above and below earlier printed lines without loss of correct positioning.

An operation to load a document into the tractor unit 10 is easily accomplished by moving the gates 98 and 112 to their open positions, as indicated by the position of the gate 112 in FIG. 1 and by the phantom lines for the gate 98 in FIG. 7. The gate 98, as well as the gate 112 is provided with a biasing spring to hold the gate in the closed position, as well as in the open position. The spring, designated by the numeral 130, is connected to the gate 98 and to an anchor pin 131 and adapted to provide an over center biasing action on the gate 98 about the pivot axis of the gate with respect to the clevis 100. Accordingly, the gates 98 and 112 are stable in both their fully open and closed positions.

With the gates 98 and 112 in their open positions, a document may be trained over the pulleys 84 of each of the tractor mechanisms 50 and 52 and the perforations in the document placed in engagement with the pins 92. The tractor unit may then be jogged to traverse the belts 54 sufficiently to feed the document downwardly along the portion of the document path which is formed between the backside of the belts 54 and the belts 94 with the document perforations in engagement with the tractor pins 56. At this point the gates 98 and 112 may be closed to retain the document in engagement with the sprockets 84. The document is then fed around the platen 12 and with the gates 68 in their open positions the document is also trained upwardly and placed in engagement with the pins 56 formed along the run on the front side of the belts 54. The gates 68 are then closed and the document is trained over the top of the roller 108 and rearwardly of the printer.

Figure 8:
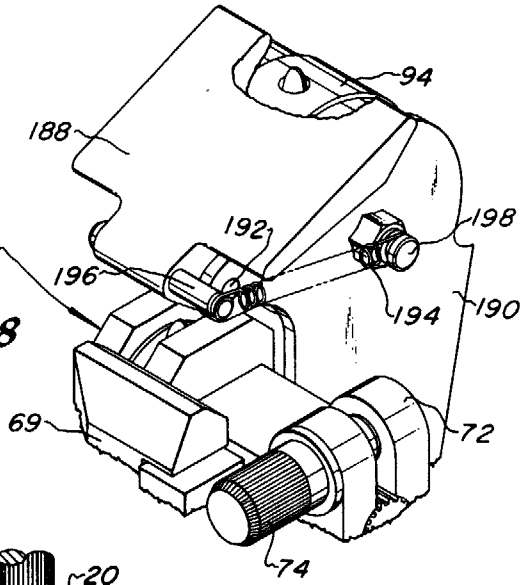
FIG. 8 is a perspective view of an alternate embodiment of a document guide member for the tractor mechanism.

An alternate embodiment of the movable guide members or gates associated with the belts 94 is illustrated in FIG. 8 in conjunction with the tractor mechanism 52. Referring to FIG. 8, which is a detail perspective view of a portion of the tractor mechanism 52, a document guide member or gate 188 is illustrated in its working position adjacent to one of the sprockets for supporting a support belt 94. The gate 188 is mounted on a pivot pin 192 which is supported on a frame plate 190 suitably secured to the tractor mechanism 52 in substantially the same manner as the plates 110 and 78 are supported on the respective tractor mechanisms as illustrated in FIG. 2, for example. However, neither the gate member 188 nor the support plate 190 need be of a left or right hand configuration and are interchangeable for use on either tractor mechanism 50 or 52. The support plate 190 includes a support shaft 198 for suitably supporting a sprocket 84 as well as idler rollers 86 and 90, not shown in FIG. 8. The gate 188 is pivotable about the axis of the pin 192 from a closed to an open position and is stable in either the fully open or closed position thanks to the arrangement of a coil spring 194 interconnected between the shaft 198 and a support pin 196. The arrangement of the gate 188 which is pivotable about an axis substantially parallel to the axis of rotation of the sprockets for the belt 94 enhances the operation of loading and unloading documents from the tractor unit 10. Moreover, the symmetrical design of the gate 188 and the support plate 190 provides for the interchangeable use on either tractor mechanism and is of less complicated mechanical design.

The tractor unit 10 of the present invention is further characterized by improved structure for supporting and guiding the document along the portion of the document travel path 58 leading to and from the tractor mechanisms 50 and 52. Referring to FIGS. 2 through 6, the tractor unit 10 includes a formed rod support member, generally designated by the numeral 132, having opposed parallel leg portions 133 and 135 which extend rearwardly of the tractor mechanisms 50 and 52 to a base or cross bar portion 137. The document support member 132 is suitably connected to the tractor unit 10 by respective mounting plates 138 and 139, FIGS. 3 and 5, fixed to the respective legs 133 and 135. The plates 138 and 139 include respective slots formed therein which hook over the roller 108 and are located by circumferential grooves formed in the roller. The distal ends of the legs 133 and 135 are bent downwardly at portions 161 and 163 and engage the beam 20, as shown. The member 132 includes further cross bars 140 and 142, which extend between the leg portions 133 and 135 generally below the cross bar portion 137, and a fourth cross bar 150. The document support member 132 may be easily mounted on and removed from the tractor unit 10 thanks to the arrangement of the mounting plates 138, 139 and the configuration of the leg end portions 161, 163.

Figure 5:
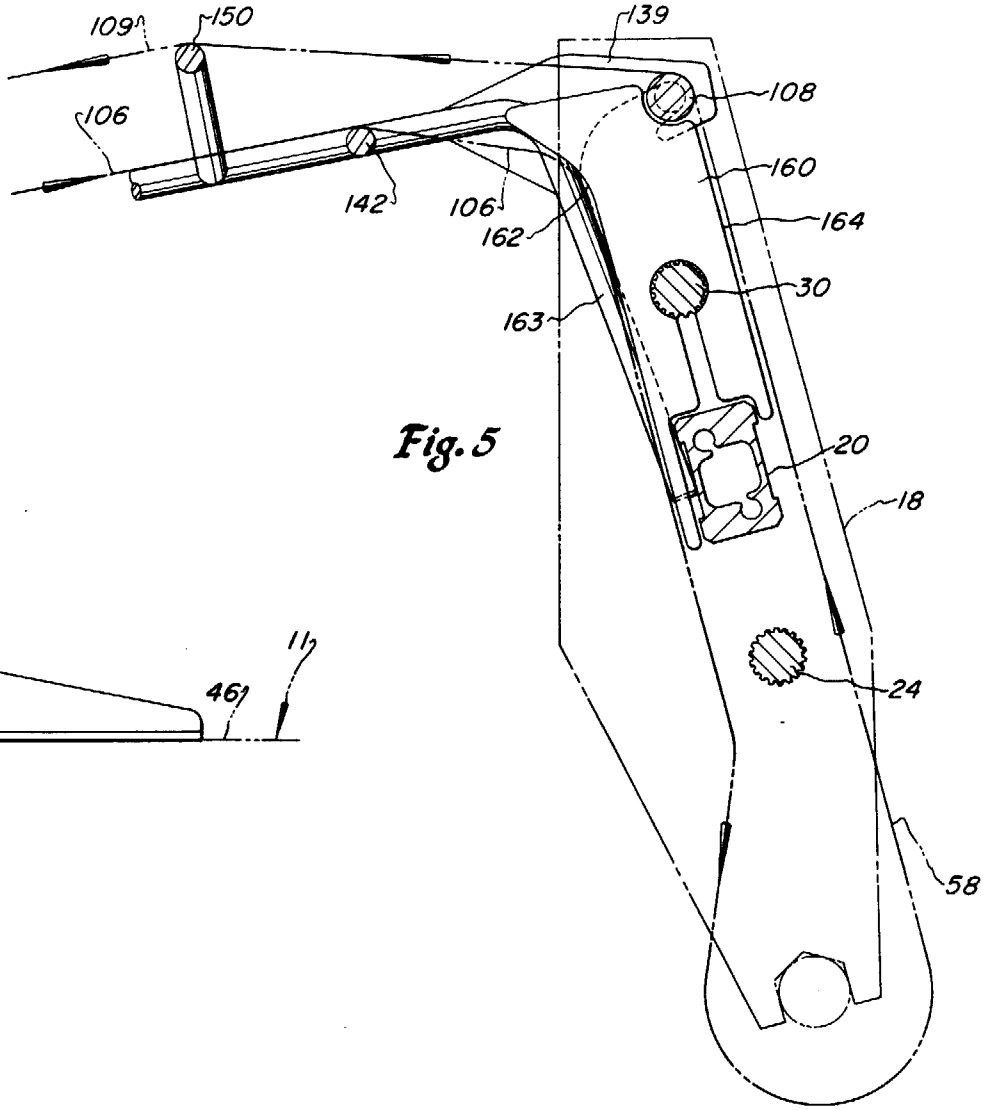
FIG. 5 is a section view taken along the line 5—5 of FIG. 1.

Referring to FIGS. 1 and 5, the tractor unit 10 includes additional document guiding means comprising a pair of guide blocks 160 having a curved document guide surface 162 formed thereon. The guide blocks 160 are slidably mounted on the stationary support shaft 30 and are engageable with the support beam 20. The guide surfaces 162 on the blocks 160 are adapted to assist in guiding the unsupported portion of the document disposed between the tractor mechanisms 50 and 52 towards the printer platen 12. Opposite support faces 164 are provided on the guide blocks 160 which also assist in supporting the document as it is leaving the printer platen in the normal direction of movement of the document through the printer. As will be appreciated from the viewing the document travel path indicated in FIGS. 3 and 5, the cross bars 140 and 142 are adapted to support the document as it is fed along the run 106 while the cross bars 137 and 150 support the run 109 to hold the document portions traveling in opposite directions apart from each other to minimize friction and possible damage to the document as it is being drivably fed through the printer by the tractor unit 10.

Those skilled in the art will appreciate from the foregoing description that the positive engagement of the opposite runs of the document with the opposite runs of the tractor belt 54, as provided by the support belts 94 and the sprockets 84 provide a superior bidirectional tractor mechanism which is relatively simple in construction and reliable in operation. Those skilled in the art will further appreciate that various modifications and substitutions may be made to the specific structure disclosed herein without departing from the scope and spirit of the present invention, as defined in the appended claims.

What is claimed is:

1. A document feeding tractor unit adapted to be mounted on a printer having a rotatable platen, said tractor unit comprising:

a frame;

a pair of document tractor mechanisms mounted spaced apart on said frame, said tractor mechanisms each including a tractor belt supported for linear traversal along oppositely moving runs, said tractor belt including a plurality of spaced apart projections engageable with said document at spaced apart perforations formed along a longitudinal side of said document;

a support member associated with each of said tractor mechanisms;

an endless flexible support belt engaged with spaced apart rotatable members mounted on said support member, said support belt being movable along one run of said tractor belt in supportive relationship with said document for maintaining said document engaged with said tractor belt, said support belt including spaced apart apertures formed therein and engageable with respective ones of said projections on said tractor belt whereby said support belt is driven by said tractor belt; and a sprocket rotatably mounted on said support member and in driven engagement with said support belt, said sprocket being drivably engageable with said document for positively driving said document in timed relation with said tractor belt.

2. The tractor unit set forth in claim 1 wherein:

said sprocket includes a plurality of circumferentially spaced apart projections extending radially with respect to the axis of rotation of said sprocket and engageable with said perforations in said document.

3. The tractor unit set forth in claim 2 wherein:

said tractor belts are disposed on said frame generally vertically above said platen whereby opposite runs of said tractor belt are engaged with portions of said document entering and leaving said platen, respectively, and said sprocket is disposed generally adjacent the leading end of one of said runs of said tractor belt with respect to the direction of movement of said document.

4. The tractor unit set forth in claim 3 wherein:

said sprocket is mounted above said tractor belt and adjacent to the leading end of the run of said tractor belt which first engages said document when said document is trained through said tractor unit.

5. The tractor unit set forth in claim 3 wherein:

said tractor mechanisms each include a document guide member disposed adjacent to and around a portion of said sprocket and movable between a closed document guiding position and an open loading position for placing said document in engagement with said sprocket.

6. The tractor unit set forth in claim 5 wherein:

said document guide members are pivotally mounted on said tractor mechanisms and include means for biasing said document guide members in the fully open and closed positions with respect to said sprockets.

7. The tractor unit set forth in claim 6 wherein:

said document guide members are mounted on said support members, said support members each providing a pivot support whereby said document guide members may be pivoted from a closed position to an open position toward the front of said tractor unit.

8. The tractor unit set forth in claim 5 wherein:

each of said tractor mechanisms includes a document guide member disposed adjacent to the other run of said tractor belt for maintaining said document drivably engaged with said projections.

9. The tractor unit set forth in claim 3 wherein:

said frame includes a pair of spaced apart vertically extending sideplates;

a beam member interconnecting said sideplates;

an elongated driveshaft rotatably supported by said sideplates and drivably engaged with said tractor mechanisms and with means for rotatably driving said driveshaft; and a document guide bar disposed above the other run of said tractor belt and supported at opposite ends by said sideplates for guiding a portion of said document leaving or approaching said other run of said tractor belt.

10. The tractor unit set forth in claim 9 wherein:

said frame includes a first support bar disposed rearwardly of said sideplates and including a portion for supporting one run of said document leading toward said sprockets on said tractor mechanisms.

11. The tractor unit set forth in claim 10 wherein:

said frame includes a second support bar including a portion for guiding said document away from said tractor unit and for supporting said document spaced from said portion of said document guided by said first support bar.

12. The tractor unit set forth in claim 1 together with:

at least one document guide block slidably mounted on said frame between said tractor mechanisms, said block including a document guide surface for guiding portions of said document extending between said sprockets and approaching said platen.

13. A document feeding tractor unit adapted to be mounted on a printer having a rotatable platen, said tractor unit comprising:

a frame;

a pair of document tractor mechanisms mounted spaced apart on said frame, said tractor mechanisms each including a tractor belt supported for linear traversal along oppositely moving runs, said tractor belt including a plurality of spaced apart projections engageable with said document at spaced apart perforations formed along a longitudinal side of said document;

a support member associated with each of said tractor mechanisms;

an endless flexible support belt engaged with spaced apart rotatable members mounted on said support member, said support belt being movable along one run of said tractor belt in supportive relationship with said document for maintaining said document engaged with said tractor belt; and one of said rotatable members being drivably engaged by said support belt and drivably engageable with said document for positively driving said document in timed relation with said tractor belt.

14. A document feeding tractor unit adapted to be mounted on a printer having a rotatable platen, said tractor unit comprising:

a frame;

a pair of document tractor mechanisms mounted spaced apart on said frame, said tractor mechanisms each including a tractor belt supported for linear traversal along oppositely moving runs, said tractor belt including a plurality of spaced apart projections engageable with said document at spaced apart perforations formed along a longitudinal side of said document;

a support member associated with each of said tractor mechanisms;

an endless support belt mounted on said support member for movement along and adjacent to one run of said tractor belt in supportive relationship with said document for maintaining said document engaged with said tractor belt, said support belt being drivenly engaged by said projections on said tractor belt; and rotatable means drivably engaged by said support belt and drivably engageable with said document for positively driving said document in timed relation with said tractor belt.

15. The tractor unit set forth in claim 14 wherein:

said rotatable means comprises a rotatable member supporting one end of said support belt.

16. The tractor unit set forth in claim 15 wherein:

said rotatable member comprises a sprocket having a plurality of circumferentially spaced apart projections extending radially with respect to the axis of rotation of said sprocket and engageable with said perforations in said document.

17. A document feeding tractor unit adapted to be removably mounted on a printer having a rotatable platen and a housing having a generally horizontally extending top surface, said tractor unit comprising:

a frame including a pair of spaced apart sideplates, and a support beam interconnected said sideplates, said sideplates including means for mounting said tractor unit on oppositely projecting shaft portions of said platen;

a pair of spaced apart tractor mechanisms mounted on said frame and including means for engaging, respectively, opposite longitudinal sides of a document for feeding said document to and from said platen, said tractor mechanisms being disposed to feed one run of said document generally vertically downward from said tractor mechanism to said platen and receive an opposite run of said document extending generally vertically upward from said platen, said tractor mechanisms each including a tractor belt supported for linear traversal to engage said opposite runs of said document, said tractor belt including a plurality of spaced apart projections engageable with said document at spaced apart perforations formed along a longitudinal side of said document, a support member on each of said tractor mechanisms, an endless support belt mounted on said support member for movement along and adjacent to one run of said tractor belt in supportive relationship with said document for maintaining said document engaged with said tractor belt, said support belt being drivenly engaged by said projections on said tractor belt; and rotatable means drivably engaged by said support belt and drivably engageable with said document for positively driving said document in timed relation with said tractor belt;

a first generally horizontally extending support bar mounted on said frame above said tractor mechanisms for supporting one of said runs of said document;

a second generally horizontally extending support bar disposed rearwardly of said tractor mechanisms for supporting said one run to or from said first support bar; and a third generally horizontally extending support bar disposed rearwardly of said tractor mechanisms and below said second support bar for supporting said other run of said document and maintaining said document runs spaced apart from each other.

18. The tractor unit set forth in claim 17 together with:

fourth and fifth generally horizontally extending support bars disposed rearwardly of said tractor mechanisms and supporting said one run and said other run, respectively.

19. The tractor unit set forth in claim 17 wherein:

said support bars other than said first support bar are formed on a document support member removably mounted on said tractor unit.

20. The tractor unit set forth in claim 19 wherein:

said document support member includes a pair of spaced apart brackets engageable with said first support bar and spaced apart generally downwardly depending leg portions of said member engageable with said support beam for supporting said member on said tractor unit.

* * * * *